US005770836A

United States Patent [19]

Weiss

[11] Patent Number: 5,770,836

[45] Date of Patent: Jun. 23, 1998

[54] RESETTABLE SAFETY CIRCUIT FOR PTC ELECTRIC BLANKETS AND THE LIKE

[75] Inventor: John Weiss, Mount Sinai, N.Y.

[73] Assignee: Micro Weiss Electronics, West Babylon, N.Y.

[21] Appl. No.: 745,884

[22] Filed: Nov. 8, 1996

[51] Int. Cl.[6] ..... H05B 1/02

[52] U.S. Cl. ..... 219/481; 219/212; 219/505; 219/517; 361/87

[58] Field of Search ..... 219/212, 481, 219/494, 505, 501, 506, 497, 488, 517; 323/235, 901; 307/117; 361/78, 87, 57

[56] References Cited

U.S. PATENT DOCUMENTS

| | | | |
|---|---|---|---|
| 4,205,223 | 5/1980 | Cole . | |
| 4,271,350 | 6/1981 | Crowley . | |
| 4,309,597 | 1/1982 | Crowley . | |
| 4,436,986 | 3/1984 | Carlson . | |
| 4,491,723 | 1/1985 | Cole . | |
| 4,943,706 | 7/1990 | Lyall et al. | 219/494 |
| 5,081,339 | 1/1992 | Stine . | |
| 5,367,146 | 11/1994 | Grunig | 219/497 |
| 5,420,397 | 5/1995 | Weiss et al. . | |
| 5,422,461 | 6/1995 | Weiss et al. . | |

*Primary Examiner*—Mark H. Paschall
*Attorney, Agent, or Firm*—Frishauf, Holtz, Goodman, Langer & Chick

[57] ABSTRACT

A safety-assuring control device for an electric blanket which includes a PTC heater includes an integrated circuit microcontroller unit having first and second safety circuit inputs and an output connected to a control input of an electrically controlled heater switch. A neon tube is connected between the primary safety link return conductor of the heater and the first safety circuit input, to indicate whether there is a first type of fault in the PTC heater. A connection between the second safety circuit input and the secondary safety link return conductor of the PTC heater is provided which indicates whether there is a second type of fault in the heater. The microcontroller unit includes a preliminary fault detection circuit for supplying a limited power test signal in a test mode to the heater for a predetermined period of time prior to a full power operation of the heater. The microcontroller unit also includes a circuit for controlling operation of the microcontroller unit to terminate supply of current to the heater if at least one fault is detected by the microcontroller at least one of the first and second safety circuit inputs during the predetermined period of time, and for controlling operation of the microcontroller unit to supply current to the heater in the full power operation if no fault is detected during the predetermined period of time.

35 Claims, 8 Drawing Sheets

RESETTABLE SAFETY CIRCUIT FOR PTC ELECTRIC BLANKETS AND THE LIKE

BACKGROUND OF THE INVENTION

1. Field of the Invention

The present invention relates to safety circuits and controls for alternating current heating pads and the like, and more particularly, is directed to safety circuits for electrical heating pads and the like which use positive temperature coefficient (PTC) materials for a heating element.

2. Description of Related Art

Heating pads and electric blankets are appliances that, by their nature, conduct high current electrical power in close proximity to the user. Besides the obvious danger of electrocution as from any electrical appliance, a health concern exists regarding the prolonged exposure to electromagnetic radiation created by the heating pad or electric blanket. Heaters and blankets of the PTC type are known to be configured so as to virtually eliminate the magnitude of the electromagnetic fields thought to be harmful. The safe operation of the PTC heating elements is the focus of the present invention. In such case, the wire is constructed with PTC electrically conductive plastic materials between two conductors, with the plastic conductor being impregnated with carbon and being irradiated with a high voltage electron beam to cross link the PTC material, improving and stabilizing the electrical characteristics of the compound.

PTC materials used for heating elements have the added safety of limiting the current draw as the temperature approaches the design limit. With this in mind, a heater can be designed without the need for an additional temperature limiting device, such as is disclosed in U.S. Pat. No. 4,271,350 to Crowely. Due to the non-linear response of temperature with current, sufficient temperature control can be achieved by proportioning power to the heater. The only condition that subverts the inherent safety of the PTC heating element is when one of the conductors, in intimate contact with the PTC material, breaks and arcing occurs. Since the heating wire used in heating pads and electric blankets is made very thin and flexible and is subjected to repeated flexing from use, folding and machine washing is particularly stressful to the thin copper conductors and in some cases causes a conductor to break. When a conductor break occurs, a line voltage can exist across the break, causing an arc to jump across the break. This arc can raise the temperature of the PTC material to auto ignition, which can start a fire. This arc will likely start a fire when allowed to continue for an extended period of time, approximately 250 milliseconds or more.

To prevent this condition from continuing and possibly causing a fire, a safety circuit is commonly used that will detect the condition, and then generate a current surge designed to blow the power input fuse, so that the unit is thereby disabled. U.S. Pat. No. 4,436,986 to Carlson senses voltage changes and conducts sufficient current to disable the unit when neon bulbs exceed their breakdown voltages. Carlson incorporates three electrodes within a neon lamp, forming a triode that breaks down at a single predetermined voltage, thus reducing the effect of breakdown voltage tolerance. Carlson uses a current limiting resistor to blow the fuse in a predetermined period of time. It is necessary for the current limiting resistor to be rated at a higher power than the fuse to provide a safe open circuit. The fuse, however, must be sized to handle currents of two or three times the continuous current rating of the heater to accommodate the inrush associated with the start up characteristic of the PTC material. The fuse is also relied upon in Carlson to deactivate the unit in all possibilities of short circuits.

A further development that improves the safety of a PTC heating element is taught by U.S. Pat. No. 5,081,339 to Stine. Stine reduces the possibility of breakage and improves the heat dissipation when incorporating a PTC heating wire within a coplanar sandwiched construction, and is used in conjunction with the heating of a waterbed so that the construction is also leak tight. A heat conductive layer and the local current throttling effect of the PTC material combine to provide the most efficient heating without occurrence of hot spots along any part of the heating element.

Typically, an adjustable bimetallic control switch is used to provide differing heat settings for the PTC heating. As the current flows through the bimetallic element, it heats up, causing the element to bend due to the differential expansion of the metals that comprise the elements. The deflection causes the contacts to open and interrupt the current to the heater and the small bimetallic element to cease bending. The bimetallic element then cools down until contact is again made and the cycle repeats. The deactivation of this type of electromechanical control, for safety reasons, is best accomplished by blowing a fuse that is in series with the switch.

Modern electrical power controls use solid state switching devices such as silicon control rectifiers, power transistors, solid state relays and triacs. U.S. Pat. No. 4,315,141 to Mills uses a pair of solid state switches biased by a temperature sensitive capacitive element as a temperature overload circuit for conventional electric blankets. In these control systems, a small signal controls switching of larger load currents. Integrated circuits or microprocessors can be used to provide the control signal required to operate high speed solid state switching. Micro circuits of this type are capable of operating at speeds many times the 50 or 60 Hz commonly used in AC electrical power supplies. This capability makes it possible to control each AC cycle. In fact, the switching can occur as the AC waveform crosses zero. This type of control can lower the noise generation associated with AC switching and makes the most efficient use of AC power.

Recent advances in microwatt power control have improved the reliability of integrated circuits by assuring the proper voltage input to the micro controller. U.S. Pat. No. 5,196,781 to Jamieson et al teaches an extremely low power voltage detection and switching circuit to provide power input to an IC within a narrow voltage band when only a low power and variable supply is available. Watchdog timing circuits can be incorporated within an IC to perform the task of periodically resetting the IC and to avoid a prolonged lockup or ambiguous operation resulting from power faults and voltage spikes often associated with AC power.

A further development that improves the safety of a PTC heating element is taught by U.S. Pat. No. 5,420,397 to Weiss et al in which detection circuits are employed to limit the arcing time and either disable the controller or switch off the power. An interruption in either the hot or neutral AC power conductors will signal the micro controller and, after a short time period, the micro controller goes into a safety mode condition, whereby power to the PTC heater is turned off. In order to prevent repetitive arcing by continuously restarting the controller, the safety mode is only reset by powering down and removing the plug from the outlet and waiting 10 seconds for the IC to lose power. Repeated and prolonged arcing will cause the arc zone to heat up, such that the arc causes the PTC material to breakdown, creating a carbon conduction path contributing to volatility of the fault.

Typically, electric blankets and heating pads are equipped with a disconnect to allow the electric blanket or heating pad to be machine washed. A controller that uses the power off safety mode, already mentioned, will go into the safety mode if the controller is turned on before the heater is connected or if the heater is disconnected when in the heating mode. A well informed user will power the controller down by removing the plug from the AC power outlet, wait, and then reconnect the power and heating pad (electric blanket) before starting. An uninformed user, accustomed to the older technology, may not recognize that the controller is not heating because of the safety mode and is apt to believe that the electric blanket is defective.

However, a problem with all of the above devices is that a fault cannot be detected before full power is applied. This can be very dangerous, since as soon as full power is provided, arcing may occur, which could result in electrocution and/or fire. It is therefore desirable to provide the unit with some means for detecting a fault before full power is applied.

In addition, with the above units, it is necessary to unplug the controller from the power mains outlet in order make a power reset possible. This is cumbersome in use.

A still further problem with the above devices is that when full power is applied, there is a current inrush to the heating wire. Therefore, it would be advantageous to reduce this current inrush when full power is applied.

OBJECTS AND SUMMARY OF THE INVENTION

Accordingly, it is an object of the present invention to provide a resettable safety circuit for a PTC heating element that overcomes the aforementioned problems.

It is another object of the present invention to provide a resettable safety circuit for a PTC heating element that overcomes the limitations of known feedback safety circuits by providing a power reset and a limited power test signal to detect a fault before full power is applied.

It is still another object of the present invention to provide a resettable safety circuit for a PTC heating element which enables a power reset without requiring that the controller be unplugged from the power mains outlet.

It is a further object of the invention to provide a resettable safety circuit for a PTC heating element which improves safety when using a heating pad or electric blanket by providing a limited power test signal capable of conditioning the heating wire to reduce the current inrush when full power is applied.

It is yet a further object of the present invention to provide a resettable safety circuit for a PTC heating element having an automatic reset feature that recognizes that the heater is not connected and automatically resets upon connection to the control.

It is still a further object of the present invention to provide a resettable safety circuit which overcomes inherent disadvantages of known devices.

In accordance with an aspect of the present invention, a safety-assuring control device is provided for an electric alternating current appliance which includes a heater having first and second heater feed conductors, the first heater feed conductor being connected to a protective fuse and connectable therethrough to an ungrounded pole of a source of electric alternating current and the second heater feed conductor being connected to an electrically controllable heater switch and connectable therethrough to a grounded pole of the source of electric alternating current. The first and second heater feed conductors, at respective ends remote from the fuse and from the heater switch, are respectively connected to primary and secondary safety link return conductors which lead towards respective connections thereof in the control device, the primary safety link conductor being connected with the secondary safety link conductor. Specifically, the control device includes an integrated circuit microcontroller unit having a first safety circuit input, a second safety circuit input, and an output connected to a control input of the electrically controlled heater switch. The control device further includes a safety circuit including at least one gas discharge current breakdown element connected between the primary safety link return conductor and the first safety circuit input, and producing a voltage drop when the at least one gas discharge current breakdown element conducts so as to produce, at the first safety input, a voltage clamped at a steady potential during half waves of one polarity of the alternating current of the alternating current source and at ground potential during half waves of another and opposite polarity of the alternating current, and an open circuit when the at least one gas discharge current breakdown element fails to conduct such that an input signal is supplied to the first safety circuit input which indicates whether there is a first type of fault in the heater. The safety circuit also includes a connection between the second safety circuit input and the secondary safety link return conductor such that an input signal is supplied to the secondary safety circuit input which indicates whether there is a second type of fault in the heater. The microcontroller unit includes a preliminary fault detection circuit for supplying a limited power test signal in a test mode to the heater for a predetermined period of time prior to a full power operation of the heater. The microcontroller unit also includes a circuit for controlling operation of the microcontroller unit to terminate supply of current to the heater if at least one fault is detected by the microcontroller at least one of the first and second safety circuit inputs during the predetermined period of time, and for controlling operation of the microcontroller unit to supply current to the heater in the full power operation if no fault is detected during the predetermined period of time.

After the supply of current to the heater is terminated in the test mode, the control device can be reset to continue operation in the test mode.

The microcontroller unit also includes a fault counter for counting the number of successive faults that are detected, and a circuit for controlling operation of the device in a safety mode after a predetermined number of successive faults have been detected by the microcontroller unit in the test mode, such that power is terminated to the heater in the safety mode. Preferably, the predetermined number of successive faults is three.

The microcontroller unit also includes a failure counter for counting the number of times that the microcontroller unit controls operation of the device in the safety mode, and a circuit for disabling the device to prevent immediate restarting thereof when the count in the failure counter reaches a predetermined number. Preferably, the predetermined number of the failure counter is five.

The predetermined period of time in the test mode is 30 seconds, and the limited power test signal in the test mode preferably has a ⅙ duty cycle with 10 continuous AC on cycles and 50 off cycles per second, lasting for the predetermined period of time of 30 seconds.

The microcontroller unit also includes a full power fault detection circuit for detecting if there is at least one fault in response to input signals to at least one of the first and second safety circuit inputs during the full power operation, and a circuit for controlling operation of the microcontroller unit to terminate supply of current to the heater to stop full power being supplied thereto if at least one fault is detected, and for controlling operation of the microcontroller unit to supply current to the heater in the full power operation if no fault is detected.

As in the test mode, after the supply of current to the heater is terminated during the full power operation, the control device can be reset to continue operation in the full power operation.

In addition, the microcontroller unit includes a fault counter and failure counter which operate in the same manner during the full power operation.

The safety-assuring control device includes a source of electric direct current supplied at a steady potential; and the microcontroller unit includes an input for an alternating voltage derived from the source of electric alternating current and an input connected with the source of direct current.

Also, the control device includes a clamping diode pair connected between the at least one gas discharge current breakdown element and the first safety circuit input for clamping the first safety circuit input of the microcontroller unit to ground or to the potential of the source of direct current.

The connection between the second safety circuit input and the secondary safety link return conductor of the safety circuit includes a resistive voltage divider connected between the secondary safety link return conductor and ground potential; and a branch circuit is connected between a tap of the resistive voltage divider and the second safety circuit input, the branch circuit including a load resistor connected between ground and the second safety circuit input, and a transistor having a switched path with one terminal of the switched path interposed between the second safety circuit input of the microcontroller unit and the load resistor and another terminal of the switched path connected with the source of direct current.

A low current resistive path is also connected between the first and secondary safety link return conductors.

In accordance with another aspect of the present invention, a method is provided for testing the safety of the aforementioned alternating current appliance prior to full power operation thereof. The method includes the steps of supplying a limited power test signal in a test mode to the heater for a predetermined period of time prior to a full power operation of the heater; terminating supply of current to the heater if at least one fault is detected by the microcontroller at least one of the first and second safety circuit inputs during the predetermined period of time; and supplying current to the heater in the full power operation if no fault is detected during the predetermined period of time.

The method includes the step of resetting the control device to continue operation in the test mode after the supply of current to the heater is terminated in the test mode.

In the method, the number of successive faults that are detected is counted, and operation of the device is controlled in a safety mode after a predetermined number of successive faults have been detected in the test mode, such that power is terminated to the heater in the safety mode. Preferably, the predetermined number of successive faults is three.

The method also includes the steps of counting the number of times that operation of the device enters the safety mode to provide a failure count, and disabling the device to prevent immediate restarting thereof when the failure count reaches a predetermined number. Preferably, the predetermined number of the failure counter is five.

Preferably, the predetermined period of time is 30 seconds, and the limited power test signal has a ⅙ duty cycle with 10 continuous AC on cycles and 50 off cycles per second, lasting for the predetermined period of time of 30 seconds.

In addition, the method performs the steps of fault counting and failure counting, which operate in the same manner during the full power operation.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
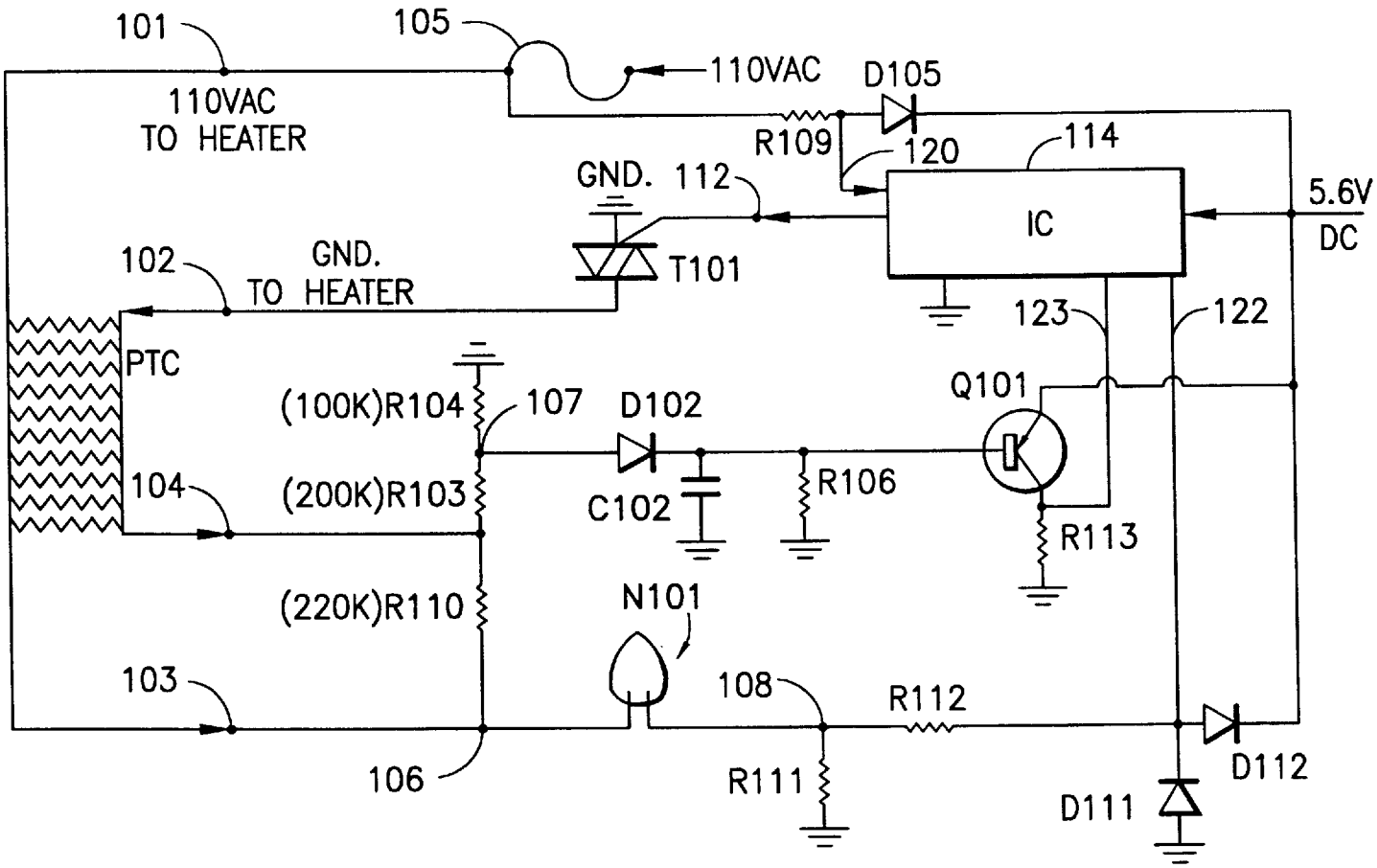
FIG. 1 is a circuit wiring diagram of a safety circuit with which the present invention can be used.

Referring to the drawings in detail, and initially to FIG. 1 thereof, there is shown a safety feedback circuit with which the present invention can be used. This circuit is similar to the circuit of FIG. 11 of U.S. Pat. No. 5,420,397 and FIG. 5 of published PCT application No. PCT/US94/00723, the entire disclosures of both, including all variations of circuit designs therein, being incorporated herein by reference.

As shown therein, a positive temperature coefficient (PTC) heater is supplied with a 110 volt, 60 HZ power input through a series connection of a heater conductor at a terminal 101 and a fuse 105. The power supply could also be a 220 volt power supply. Thus, fuse 105 is interposed between the hot side of the 110 VAC source and the PTC element, such that on the protected side of fuse 105 there is a low current connection to supply an integrated circuit (IC) 114 with a source of alternating current for timing and also (by means not shown in FIG. 1) to provide a source of DC voltage, as well as a connection to the PTC heater through terminal 101. The circuit is completed by a second power conductor of the PTC heater at terminal 102 which is switched through ground via a triac T101. Thus, the heating current goes through the PTC heating element and returns to ground through triac T101. Triac T101 will not conduct power until a signal is sent to a gate 112 thereof by IC 114, which controls firing of triac T101. To avoid noise associated with switching AC loads that may affect other appliances, TVs, radios, etc., a high impedance AC signal is input to IC 114 through a resistor R109 and clamped to a DC power input voltage of, for example, +5 volts, through a diode D105. This AC signal is used for determining the AC phase angle. This signal is used to coordinate the firing of triac T101 as the AC power waveform is near the zero crossing. In this way, switching occurs at an instantaneous low voltage, preventing voltage spikes which may occur when switching at other than 0° or 180° phase angles.

The resistance of the PTC heater is between the conductors at terminals 101 and 102. This resistance is low at first, causing a high current draw. As the temperature of the PTC material heats up, the resistance between conductors 101 and 102 increases and less current is drawn. The PTC heater is considered to be in parallel relation between the conductors associated with terminals 101 and 102. The conductor at terminal 101 returns to the control circuit through terminal 103 and the conductor at terminal 102 returns to the control circuit through terminal 104. Thus, the conductor at terminal 102, which is connected to the ungrounded side of triac T101, is connected to a ground heater conductor for connection with the grounded side of all of the individual heating elements of the PTC heater, and ultimately to terminal 104. Similarly, on the high voltage side of the PTC heater, the conductor at terminal 101 becomes an AC feeder conductor for all of the individual heater elements in parallel and then proceeds to connect with terminal 104. Thus, the conductors at terminals 103 and 104 provide return lines used for control purposes. The circuit connected to terminal 103 may be referred to as the primary return line circuit and the circuit connected to terminal 104 may be referred to as the secondary return line circuit, since it receives energization only after the current has passed through the PTC heater.

Terminal 103 is connected to terminal 104 through a resistor R110, and terminal 104 is connected to ground through a pair of resistors R103 and R104. Resistors R103 and R104 form a voltage divider.

The PTC conductors are returned to the safety circuit independently to condition for analysis by IC 114. Conditioning includes positive switching on both the 110 VAC and ground return signals, avoiding signal level determination by IC 114.

During the heating cycle, the conductor between terminals 102 and 104 is connected to ground, and this conductor has a resistance of 7 ohms, so that the AC voltage at terminal 104 is low, and specifically, in the range from 2 to 10 volts. At this level, the voltage drop through the voltage divider of resistors R103 and R104, halfwave rectified through a diode D102 and stabilized by a capacitor C102 and a resistor R106, is not sufficient to bias off the transistor Q101, whereby conduction between the emitter and collector provides a 5 volt signal to the IC at input 123 thereof.

If the conductor breaks between terminals 102 and 104 and arcing occurs, the AC voltage at terminal 104 goes high and the signal to the base of transistor Q101 blocks conduction, whereby the signal at input 123 goes to ground through a resistor R113 connected between the collector of transistor Q101 and ground. If the conductor between terminals 102 and 104 breaks near the end of the PTC heater or beyond the end, resistor R110 connected between the primary and secondary return lines will provide the AC signal at terminal 104.

The 110 VAC return at terminal 103 is connected to a gas discharge tube N101, which may be a neon or other rare gas discharge tube, and which is connected to ground through a series resistor R111. Neon tube N101 is preferably selected to have a breakdown voltage of 75 to 85 volts. However, in the case of a 220 VAC input, three such neon tubes N101 are preferably provided in series, with each neon tube N101 having a breakdown voltage of 55 to 65 volts, thus providing a turn-on threshold between 165 to 195 volts of half wave rectified alternating current. In the latter case, a diode is preferably provided at the input of the neon tubes N101 for half wave rectification, and to reduce the power and heat dissipated in the primary return line circuit. Such diode may be omitted in 110 VAC appliances.

The AC signal at terminal 108 between neon tube N101 and resistor R111 is connected to input 122 of IC 114 through a resistor R112, and is clamped to 5 volts by diode D112 during the positive half cycle and to ground by diode D111 during the negative half cycle. IC 114 reads the signal at input 122 at a phase angle of 90° looking for 5 volts. If arcing or a break occurs any place along the 110 VAC conductor between terminals 101 and 103, the voltage across neon tube N101 drops below the breakdown voltage and opens the circuit between terminals 106 and 108. In other words, the required breakdown voltage across neon tube N101 is greater than the input voltage, so that neon tube N101 is off. This results in a drop in the voltage at input 122 to ground through resistor R111.

Figure 2:
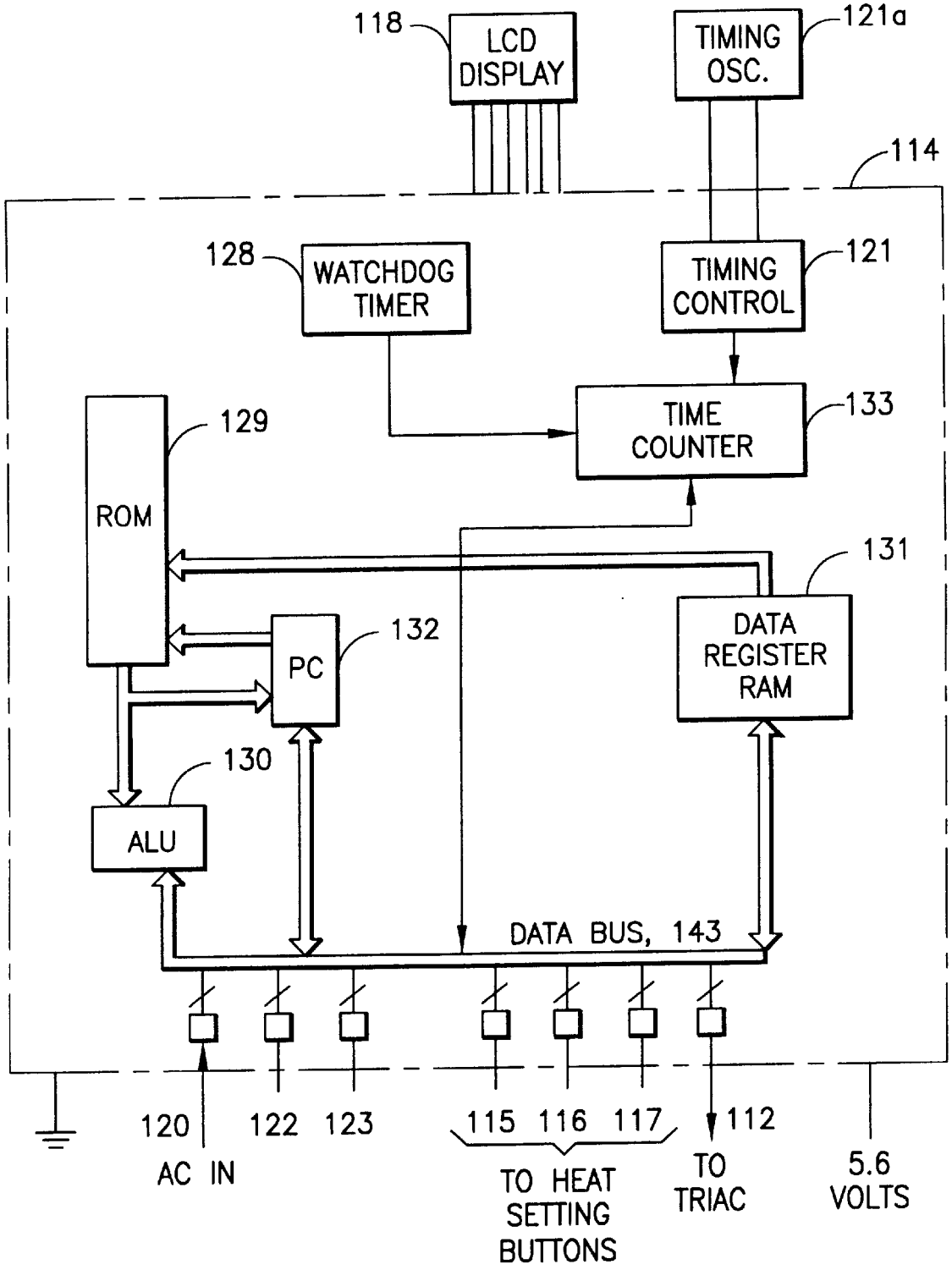
FIG. 2 is a block diagram of the micro controller IC of the circuit of FIG. 1.

As shown in FIG. 2, IC 114 is of the type that employs a watch-dog timer that operates independently from the IC timing control to continuously reset the program, and thus becomes unaffected by noise and is prevented from becoming locked up.

Micro controller IC 114 includes a read only memory (ROM) 129, which stores the algorithms and instruction set that comprise the program to control the heating and the display arc. The instructions from ROM 129 are processed within an arithmetic logical unit (ALU) 130, and the resulting values are decoded and stored in a data register comprised of a random access memory (RAM) 131, to be used as an input to the program. The input signals, AC in, safety circuit inputs 122 and 123, and the control inputs (heat setting buttons) 115, 116 and 117, are received through the data bus 143. The program determines when power is to be supplied based on the input from the safety circuit and the control status. The firing of triac T101 is coordinated with the AC waveform input to IC 114 through the AC in port 120 to trigger triac T101 at the zero crossing. A program counter (PC) 132 is required to keep track of the program steps and index to the next program instruction.

A timing control circuit 121 serves to control the clock speed at which the program operates and includes a typical RC oscillator 121*a*. A crystal oscillator can also be used. Typically, the clock speed is in the order of 1 to 2 MHz.

A watchdog timer 128 is set to overload periodically, which initiates a device reset. Upon reset, the program is initialized and starts from the beginning. Watchdog timer 128 intermittently times out the microprocessor operation for a preset period, adjustable between 0.01 and 3 seconds. Time counter 133 and program counter 132 are also reset. If a lock up occurs, watchdog timer 128 having its own internal oscillator, will continue to count down and then reset the program. The timeout mode is also enacted upon power up to assure the proper voltage is input to the microprocessor, thus allowing the power circuit time to stabilize. Watchdog timer 128 is important to guarantee the processing of the safety circuit signal. Watchdog timer 128 may also reset the microprocessor circuit 114 in all situations involving noise pulses that may corrupt memory or cause a lock-up. While in the heating cycle, IC 114 produces an output signal at port 112 that triggers triac T101, connecting the AC signal to the PTC heater. The output signal 112 controls the firing of triac T101. OKI Co. device number MSM64162 is one example of a micro controller IC 114 that can perform the functions as stated above.

Figures 3, 4A, 4B, 4C, 4D:
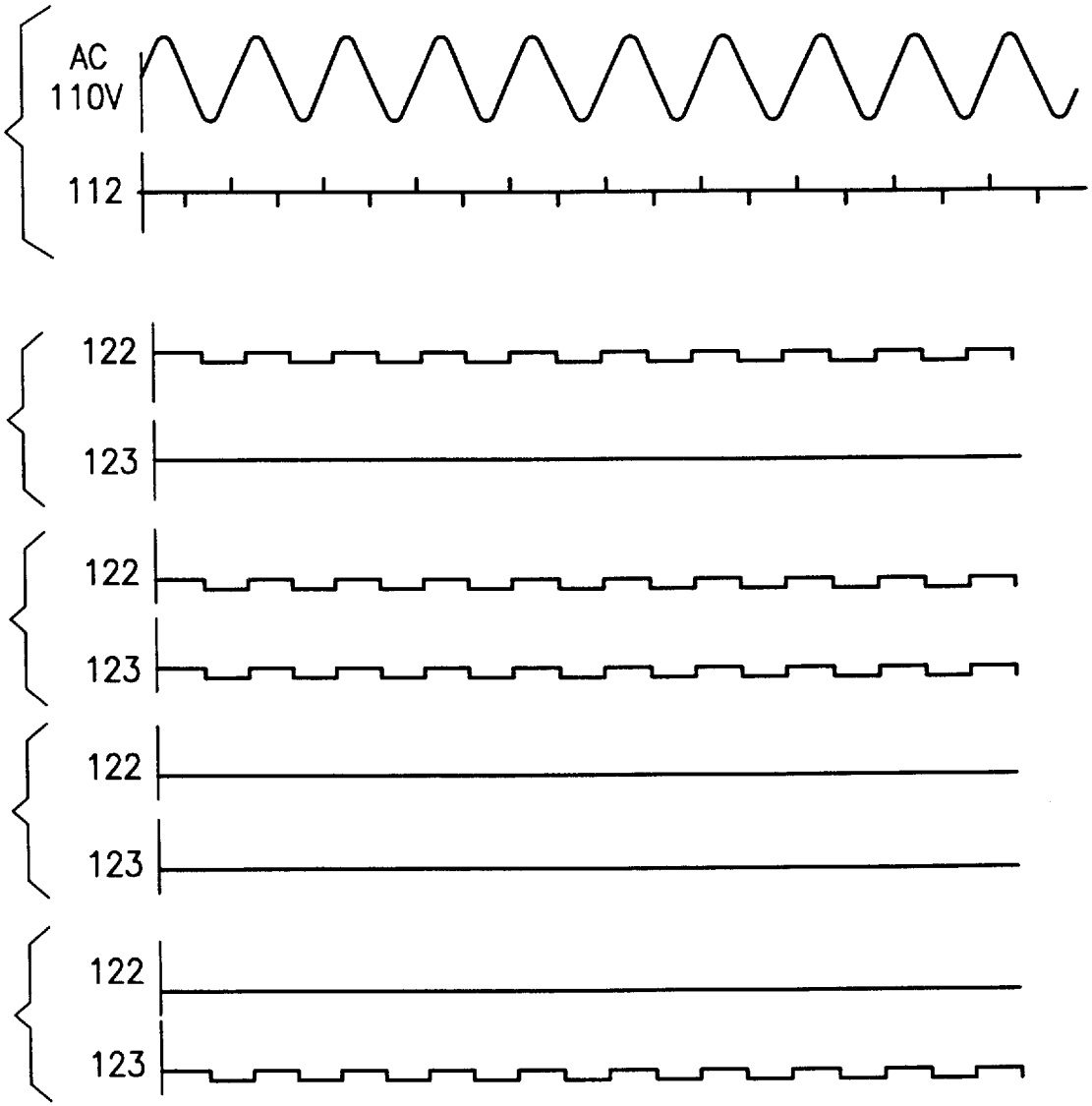
FIG. 3 is a graphical drawing over time of the power and control signals used with the circuit of FIG. 1.
FIGS. 4A–4D are graphical drawings over time of the feedback signals generated by the circuit of FIG. 1.

The AC power input and the triac trigger signal are shown in FIG. 3, where the signal time period is 60 Hz for 10 cycles. For the same time frame, FIG. 4 shows the possible combination of signals that will be input to IC 114 for determination of a safe operation. Referring to FIG. 4A, the 60 Hz pulse at input 122 and ground at 123 is the signal combination required for safe operation. FIG. 4B shows the signals at inputs 122 and 123 when a break in the heater ground conductor has occurred. FIG. 4C is the signal combination resulting from a break in the heater 110 V conductor. The signal combination of FIG. 4D would be expected when both the 110 VAC and the ground heater conductors are open. This typically occurs if the PTC heater is not connected to the controller. The signal analysis of one of FIGS. 4B, 4C and 4D could result in the interruption of triac trigger signal 112, shown in FIG. 3, and thus the interruption of the 110 VAC power to the PTC heater. In the case of FIGS. 4B and 4C, this power interruption will prevent the PTC material from arcing and causing a fire. For the open circuit condition of FIG. 4D, when the user has not yet plugged in the heater, the power interruption eliminates the possibility of electric shock from touching the plug or receptacle.

Thus, the program stored in ROM 129 of IC 114 has a routine to analyze feedback signals 122 and 123. Specifically, IC 114 is programmed to look for 5 volts at input 123 during the heating cycle and 5 volts at input 122 at a 90° phase angle in order for safe operation. Each time this condition is not detected, an error counter is incremented by 1 and when the error count is 5, in approximately 60 milliseconds, triac T101 is disabled and the LCD display 118 is turned off or flashed. This error mode can only be reset by unplugging the controller, waiting a few seconds, plugging in the controller and then turning the controller on.

Figure 5:
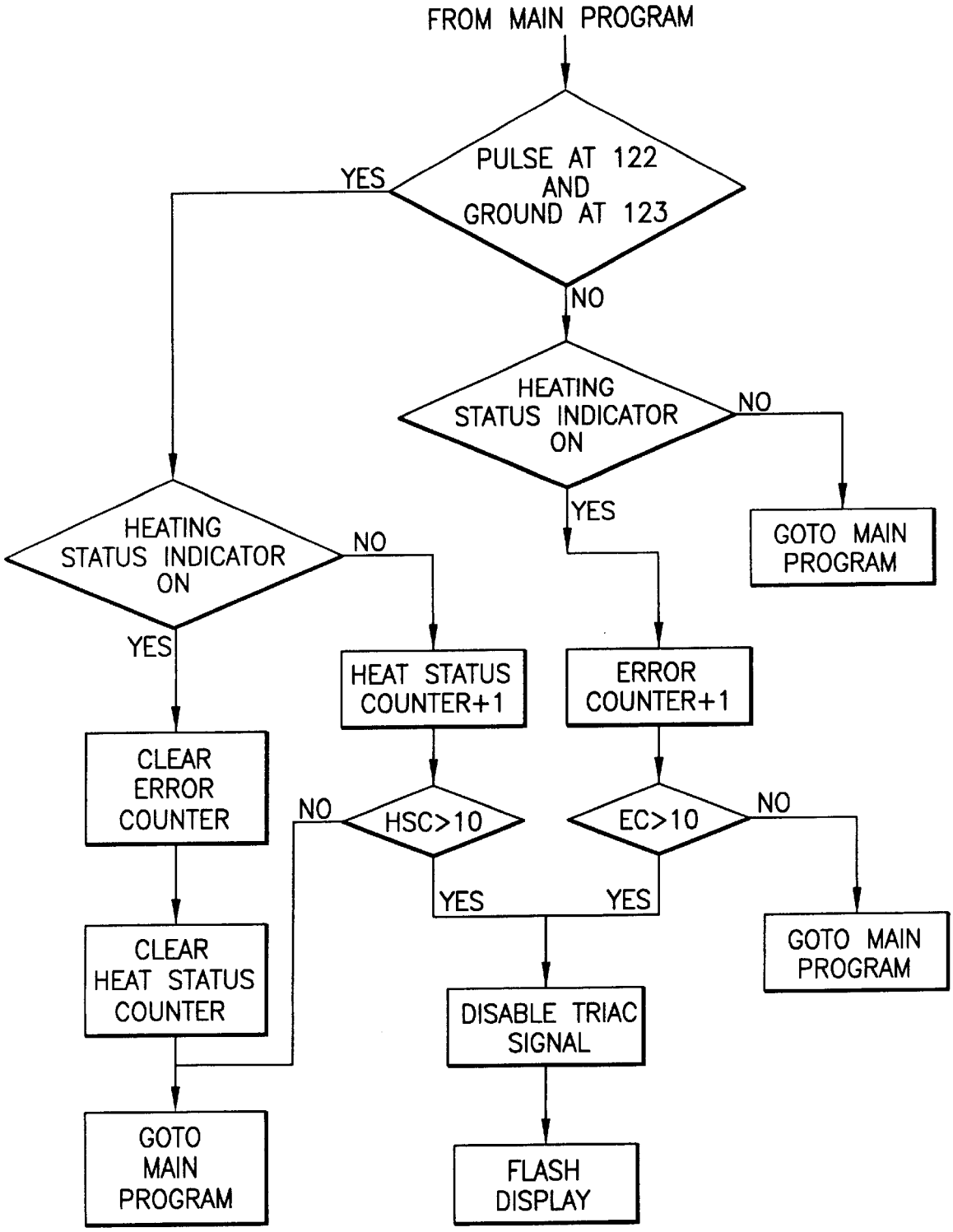
FIG. 5 is a flow chart of the program used with the microprocessor IC in FIG. 2.

Referring to the routine flow chart of FIG. 5, the first instruction looks for the safe signal (FIG. 4A). If the pulse is detected at input 122 and ground is detected at input 123, then the result at the first stage is YES and the next instruction is to verify that the heating cycle is on. If triac T101 has failed in the short circuit condition and heating is in the off mode, then a NO answer to the heating status indication routs the program to the Heat Status Counter (HSC) subroutine. The HSC subroutine adds one to the HSC value and then compares the value to 10. If the count is greater than 10, then 10 consecutive cycles indicate triac failure and the subroutine is routed to fault protection and the alarm routine. If the Heating Status indicator is on, normal operation is occurring and the Error Counter and the Heating Status Counter are set to zero and the routine goes back to the main program.

At the first stage, if the pulse is not detected at input 122 or a pulse exists at input 123, then the answer is NO and if the Heating Status indicator is on, then an error condition exists that would indicate an unsafe operating condition. At this point, the error counter is indexed by one and in ten cycles, that is, approximately 87 milliseconds, the subroutine is routed to the fault safety routine, disabling triac T101, flashing the display 118, flashing an indicator light or sounding an alarm. The error count is set, for example, to 10 to react to a fault in 87 milliseconds. However, the count can be smaller if a quicker reaction is required. The count should not be as small as one in order to prevent nuisance failures that may result from power fluctuation. It is quite practical for the HSC subroutine error count threshold to be only 5.

The conditioning circuits are made of discrete components operating at low current. Neon tube N101 is selected for breakdown voltages of 75 to 85 volts, and since it has the characteristic of increasing breakdown voltage after 10,000 hours of use, this produces a failsafe condition.

Typical values of the components used to demonstrate the action of this embodiment are listed in Table 1. However, the actual values used will depend on the required response time to determine a fault.

TABLE I

| Component | Type or Value |
|---|---|
| T101 | TRIAC |
| Q101 | PNP TRANSISTOR VCE > 35 VOLTS |
| N101 | NEON TUBE BDV AC 75–85 VAC |
| R104 | 100K RESISTOR ⅛ WATT |
| R103 | 200K RESISTOR ⅛ WATT |
| R106 | 470K RESISTOR ⅛ WATT |
| R110 | 220K RESISTOR ⅛ WATT |
| R111 | 20K RESISTOR ⅛ WATT |
| R112 | 1K RESISTOR ⅛ WATT |
| R113 | 20K RESISTOR ⅛ WATT |
| R109 | 1M RESISTOR ⅛ WATT |
| D102, D105, D111 AND D112 | IN 4001 DIODES |

The above circuits are know and are described in U.S. Pat. No. 5,420,397 and published PCT application No. PCT/US94/00723, the entire disclosures of both, including all variations of circuit designs therein, being incorporated herein by reference.

The present invention is an improvement on the above devices, by using substantially the same circuitry, but changing the programming of IC 114. As will now be described, the present invention provides a power reset and a limited power test signal to detect a fault before full power is applied, while also enabling a power reset without requiring that the controller be unplugged from the power mains outlet. The limited power test signal also functions to condition the heating wire to reduce the current inrush when full power is applied. In addition, an automatic reset feature is provided that recognizes that the heater is not connected and automatically resets upon connection to the control.

Figure 6:
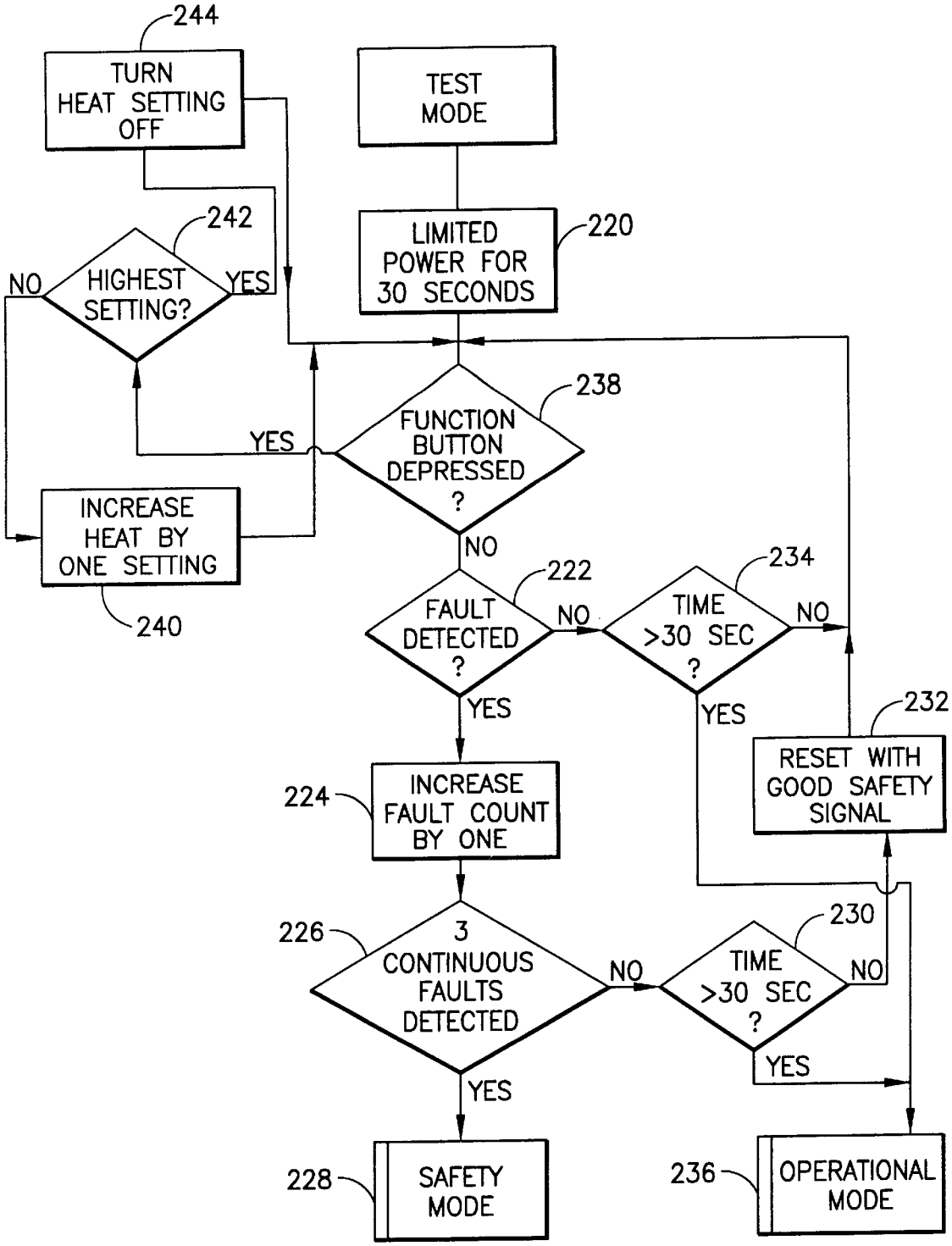
FIG. 6 is a flow chart of the program for the TEST MODE which is used prior to full power being applied.

Referring now to FIG. 6, a flow chart diagram for the TEST MODE program for the present invention will now be described.

The zero crossing detecting circuit already employed for triac firing, along with diode D105, pull a limited AC signal high (to 5 V DC), such that the resulting square wave determines the zero crossings and phase angles. The safety circuit feedback which is input to IC 114 at inputs 122 and 123 is similarly conditioned. Thus, as described above, triac T101 is fired at a 0° phase angle and a 180° phase angle, and the error detection inputs are read into the program logic data at a 90° phase angle and a 270° degree phase angle.

The operation is started by depressing a control button once, such that the lowest or default setting appears on LCD or LED colored display 118. Another push of the button will scroll through the settings.

In the TEST MODE, as shown in the flow chart diagram of FIG. 6, for thirty seconds after control IC 114 is activated, limited or reduced power is supplied to the PTC element in step 220. The initial test power is limited by having a ⅙ duty cycle (10 continuous AC on cycles and 50 off cycles per second), lasting for thirty seconds. Each of the 10 on cycles are tested at 90° and 270° phase angles by the error detector input signals at inputs 122 and 123 of controller IC 114. While in the TEST MODE, if a fault is detected at 90° and 270° phase angles (step 222), a fault counter is incremented to accumulate the number of faults at step 224. If three continuous faults are detected in step 226, control IC 114 goes into the SAFETY MODE in step 228.

If there is no detection of three continuous faults in step 226, it is determined if 30 seconds has elapsed, that is, whether 30 test pulses have been provided in step 230. If 30 seconds have not elapsed, each fault detection will result in a SAFETY MODE power off and selection of the function button will restart the control in the test mode, in step 232, which thereafter returns to step 222. In step 232, resetting can be made to occur manually by a user or automatically. In the automatic reset mode, controller IC 114 first looks at the signal from input 122 when three seconds of continuous positive signals are received and then control continues in the limited power TEST MODE.

If there is no fault detection in step 222, it is determined if 30 seconds has elapsed in step 234, and if no, the process returns to step 222.

If 30 seconds have elapsed at steps 230 or 234, the process proceeds to the OPERATIONAL MODE in step 236.

A step 238 is interposed between steps 220 and 222 which detects, in the TEST MODE, if a heat adjustment function button is depressed. If yes, it is determined if the heat is already on the highest setting in step 242. If yes in step 242, then the heat setting is turned off in step 244. If no in step 242, the heat is incremented to the next highest setting in step 240, and the process proceeds to step 238 again. If the answer to step 238 is no, the process proceeds to step 222 to continue the process as described above.

In addition to testing the wire for a fault under limited power conditions, the test signal provides enough power to heat the PTC material. The resistance of the PTC wire changes with temperature in a non-linear relation, and similarly, the current changes non-linearly with temperature. A plot of current versus time demonstrates how current will decrease and approach a steady state condition with time. The initial current inrush is seven times higher than the steady state current. The thirty second test signal described above is equivalent to five seconds of full power, having a ⅙ duty cycle. Therefore, when full power is applied after a successful test period, the wire is sufficiently heated so as to lower the inrush current by 35%. Electric blankets having longer wires, up to 150 feet, require a test signal of longer duration to further reduce the inrush and condition the wire for full power. The lower current in combination with the short detection period of, for example, 50 milliseconds, severely limits the power during a fault condition, thereby limiting the potential of a hazard. The threshold energy required to ignite the PTC material is not achieved during the test mode and the PTC material is conditioned by the temperature increase resulting from accumulated test signals to draw lower current, preventing the power from achieving a hazardous threshold during the fault detection period.

Figure 7:
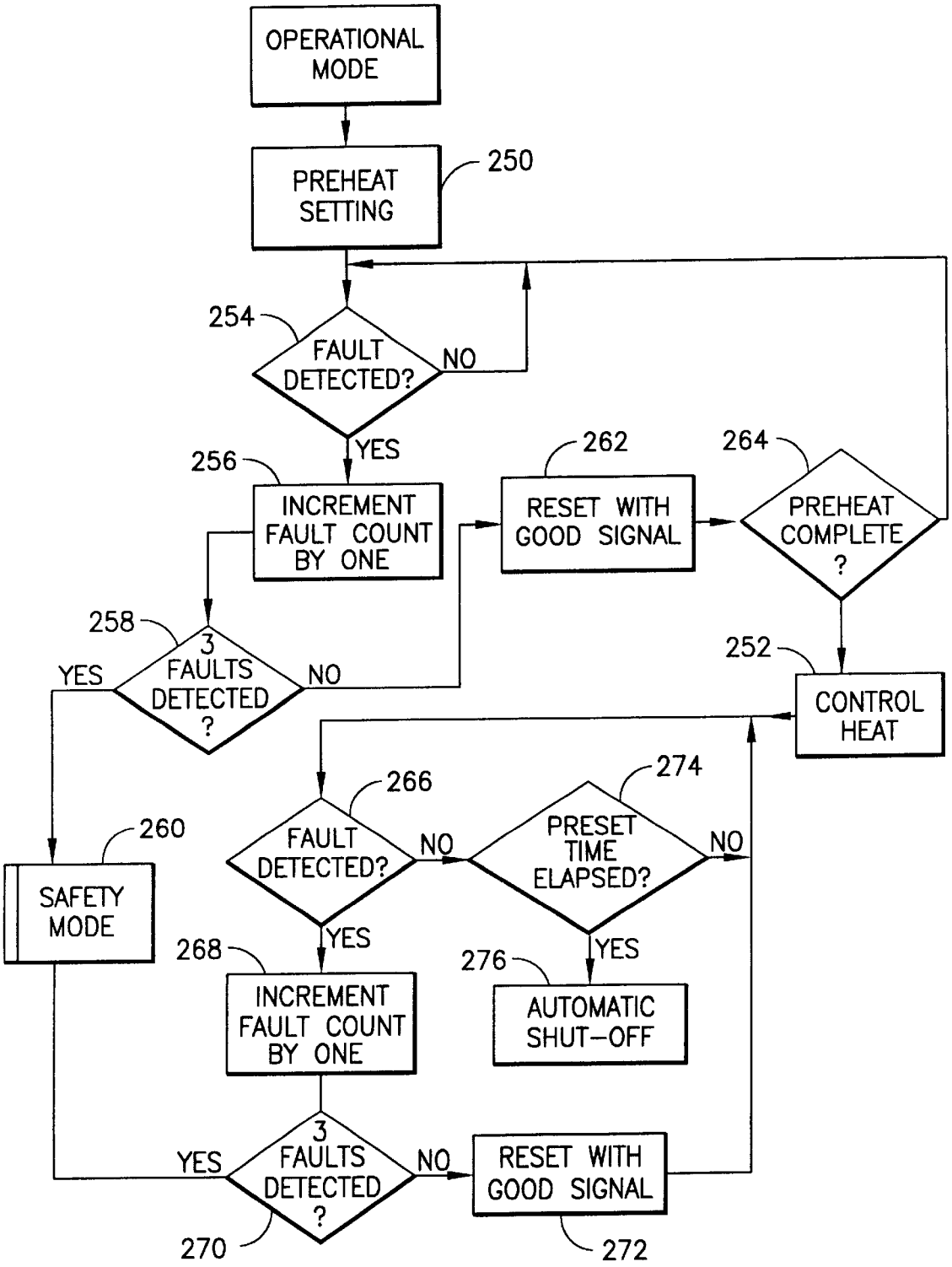
FIG. 7 is a flow chart of the program for the OPERATIONAL MODE.

In the OPERATIONAL MODE, as shown by the flow chart of FIG. 7, triac T101 is fired at 0° and 180° for continuous full power for a preheat time relating to the setting (step 250). After the preheat mode is complete, the power is switched on by a time proportion according to the setting to supply full heat in step 252 of the control mode. As an example, of preheat time in step 250, LO power can be provided for one minute, two minutes of MID power, four minutes of MID-HI power and continuous HI power in the control mode.

In the preheat mode, IC 114 always looks for a fault. If a fault is detected at 90° and 270° phase angles (step 254), a fault counter is incremented to accumulate the number of faults (step 256). If three continuous faults are detected in step 258, control IC 114 proceeds to the SAFETY MODE in step 260.

If there is no detection of three continuous faults in step 258, each fault detection will result in a SAFETY MODE power off, and selection of the function button will restart the control in the test mode (step 262). In step 262, resetting can be made to occur manually by a user or automatically. It is then determined in step 264 if the preheat stage is completed. If not, the process returns to step 254. If yes, the process continues to the control mode of step 252.

In the control mode, the control time proportions the power according to the setting. For example, a LO setting corresponds to 5 seconds on, 25 seconds off; a MID setting corresponds to 15 seconds on, 15 seconds off; a MID HI setting corresponds to 22 seconds on, 8 seconds off; and a HI setting corresponds to 30 seconds on, 0 seconds off.

As in the preheat mode, IC 114 always looks for a fault in the control mode. If a fault is detected at 90° and 270° phase angles (step 266), a fault counter is incremented to accumulate the number of faults (step 268). If three continuous faults are detected in step 270, control IC 114 proceeds to the SAFETY MODE in step 260.

If there is no detection of three continuous faults in step 270, each fault detection will result in a SAFETY MODE power off, and selection of the function button will restart the control in the test mode, in step 272, and the process returns to step 266. In step 272, resetting can be made to occur manually by a user or automatically.

In the OPERATIONAL MODE, there is also a time out stage. Specifically, after step 266, it is detected if a preset time of, for example, 2, 12 hours or any other set value, has elapsed (step 274). If no, control returns to step 266. If yes, there is an automatic shut-off of the circuit in step 276, whereby all defaults are reset and the unit is ready for an on button command.

As discussed above, the process will go to the SAFETY MODE in the event that three continuous faults are detected in either the TEST MODE or the OPERATIONAL MODE, that is, each time the fault counter reaches a count of three.

Figure 8:
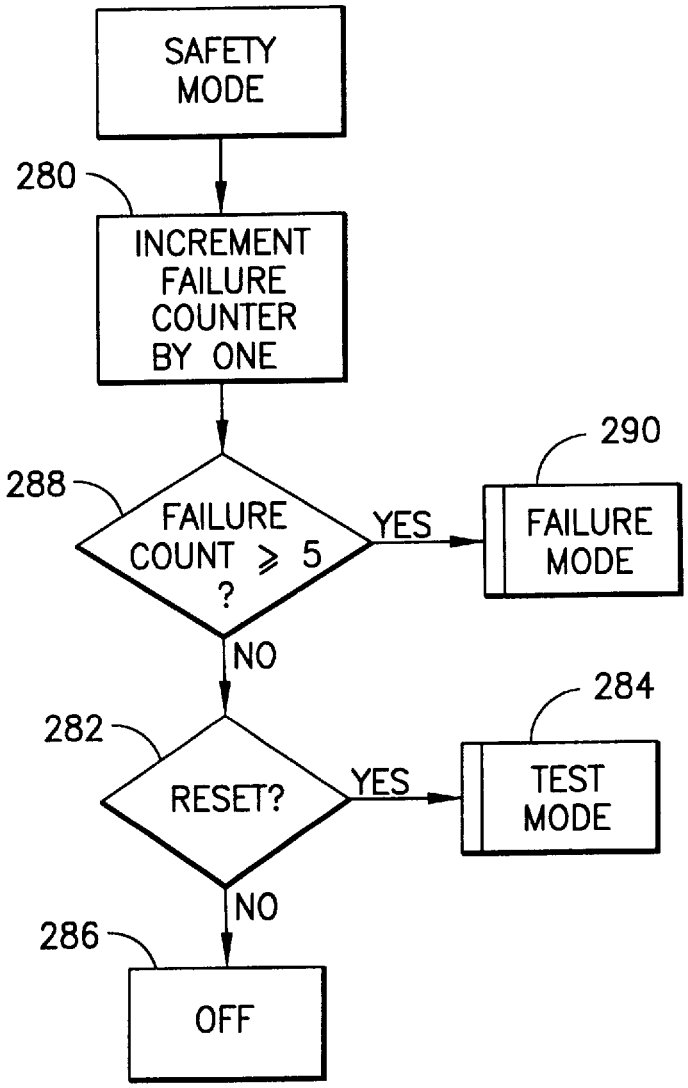
FIG. 8 is a flow chart of the program for the SAFETY MODE.

In the SAFETY MODE, as shown in the flow chart of FIG. 8, that is, each time the fault counter reaches a count of three, a failure counter in the SAFETY MODE is incremented by one (step 280). If the unit is then reset in step 282 to supply power to the PCT heater, the unit enters the TEST MODE in step 284, and the same fault detection process as discussed above is repeated. If the unit is not reset, it is turned off in step 286.

Each time that the fault count reaches a count of three, the system goes into the SAFETY MODE, and the failure counter is incremented by one in step 280. if the failure counter reaches a count of 5, this is detected in step 288 and control IC 114 directs the program to go into failure mode in step 290, not allowing the system to reset. The control IC 114 can only be reset from the failure mode 290 by unplugging the device from the AC power outlet and waiting for micro control circuit 114 to drain to near 0 volts. Thus, the control button is not operational in the failure mode. The failure counter can also be reset after several hours of continuous safe use.

For critical applications, an EEPROM retainable memory can be included to prevent unsafe operation after the certainty of a fault causes the control to go into failure mode.

In such case, the failure mode is permanently stored such that an initiation will be unsuccessful and such that the control remains in failure mode.

A common occurrence happens when the user turns the control on before the blanket is plugged in. In such case, the control goes immediately into the SAFETY MODE. Accordingly, the user presses the on button twice, and the circuit goes into the SAFETY MODE, at which time the user realizes the blanket was just washed and not plugged in. After attaching the blanket, the on button then resets controller IC 114 and the TEST MODE completes the 30 seconds of test pulses and goes into the preheat and control modes at which time the fault counter which is now set at 2, is reset to zero.

Thus, in accordance with the present invention, there is an automatic reset.

As discussed above, when the blanket or heating pad is not plugged into the controller, the power is turned on for only three AC cycles, that is, for 50 milliseconds, the power is terminated and the control logic is in the SAFETY MODE. During this detection time with both conductors open, input 122 will communicate error conditions to controller IC 114. This condition will also occur if, upon start-up, the conductor between terminals 101 and 103 is open, or if there is a double conductor break with the conductors between terminals 102 and 104 and terminals 101 and 103. The double conductor break usually results from a cut wire and is rare. Also, in the event of a double conductor break, the spacing between conductors is too large to support an arc with normal household voltage. Upon start-up, the TEST MODE can be preempted by a three second test looking for a positive signal at input 122 before power up into the TEST MODE. In fact, the control can wait for three seconds of continuous positive input and then start-up. When the pad is attached, neon tube N101 is supplied with power through the conductor at terminals 101 and 103. Neon tube N101 will not turn on unless the PTC heater is attached.

In the event of a neutral conductor break, the resistance across the break will form a voltage divider with the PTC resistance and pull terminal 104 high. Resistor R110 will pull terminal 104 high if the neutral break is within the PTC section near terminal 104. In this manner, the PTC wire is sensitive to a break along the entire length of the PTC section, and in fact, is sensitive to a break within the control wire as well.

With the heater attached, the neutral output terminal 104 is connected to the opposite polarity through the PTC resistance and resistor R110 until triac T101 switches on and connects to AC neutral. Before heater power is switched on by triggering triac T101, the voltage at terminal 104 is high relative to the neutral side if the connector is engaged, and neon tube N101 is only powered on when the connector is engaged. Thus, both input signals 122 and 123 to IC 114 change states when the connector is engaged before power to the heater is switched on.

Electric blankets usually require longer wire lengths than that required for heating pads. Typically, heating pads use less than 30 feet of PTC heating wire whereas electric blankets use over 100 feet of PTC heating wire. If, as shown in FIG. 1 of the drawings, the PTC heating wire is powered from a first end with an opposite end coupled to the safety circuit, a voltage drop occurs along the length of the wire conductors. This causes lower currents to pass through the PTC material at the opposite end of the PTC heating wire as compared to the first end of the PTC heating wire. This results in uneven heat production. In order to overcome this problem, the effective length of the wire can be reduced by powering the PTC heating wire from opposite ends. When the PTC wire is powered from opposite ends, the current drops are toward the center of the wire and are substantially half of the current drop when the PTC wire is powered from only one end. An example of powering heating wire from opposite ends is shown in FIG. 3 of U.S. Pat. No. 4,436,986 to Carlson, the entire disclosure of which is incorporated herein by reference.

Figure 9:
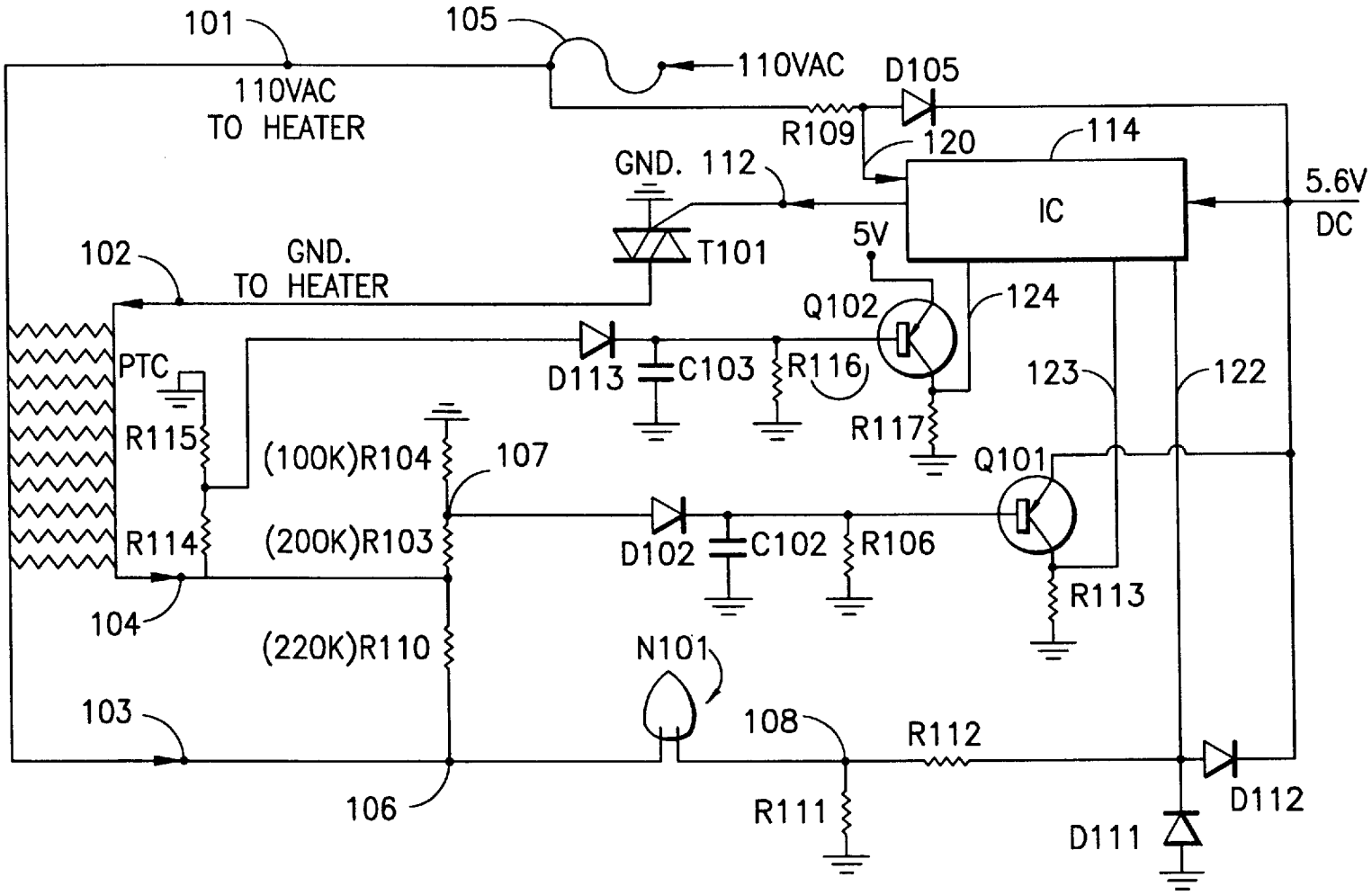
FIG. 9 is a circuit wiring diagram of a safety circuit having a double voltage divider.

Referring now to FIG. 9 which is a modification of FIG. 1, the voltage drop between terminals 102 and 104 increases when the PTC heating wire length is long. This results in a higher input voltage to voltage divider R103 and R104. The voltage input to the neutral side of the safety circuit at terminal 107 is preferably of a value such that when the voltage is rectified by D102 and stabilized by the RC circuit formed by capacitor C102 and resistor R106, the voltage is less than the threshold voltage required to bias transistor Q101. This "tuning" of the voltage divider is preferably accomplished by proportioning the voltage divider (R103 and R104) by reducing R104 from 100K to 65K.

As previously described, when power is first provided to the PTC heating wire, the current draw is very high causing a significant voltage drop along the conductors. However, as the temperature of the wire increases, the resistance of the PTC heating wire increases and the voltage drop along the conductors decreases. In an alternate embodiment, the limited power test signal, as previously described, is used to preheat the wire before continuous full power is applied. Once the temperature of the wire increases, the original voltage divider resistor values will result in the proper voltage to the safety circuit. In an alternate embodiment as shown in FIG. 9, a second voltage divider consisting of R114 and R115, is coupled between terminal 104 and ground to provide an additional (third) safety signal to input pin 124 (third safety circuit input) of IC 114. Circuit components diode D113, capacitor C103, resistor R116, transistor Q102, and resistor R117, coupled as shown in FIG. 9, act in the same manner to condition the third safety signal provided to the IC 114 as described with respect to diode D102, capacitor C102, resistor R106, transistor Q101 and resistor R113 with respect to input pin 123 of IC 114. The values of the resistors which form the second voltage divider (R114 and R115) are preferably chosen for the cold wire conditions and the values of the resistors which form the first voltage divider (R103 and R104) are preferably selected for the warm wire conditions. As a result, a determination can be made as to when to stop providing the test signals and when to turn full power on. The double voltage divider (i.e., combination of first and second voltage dividers) functions as a temperature switch that is used to switch the control from limited power preheating mode to the full power mode as previously described. The aforementioned embodiment is advantageous because the amount of current flow is controlled without the need for separate and multiple thermostats and their corresponding connections. Since less thermostats and connections are utilized, the likelihood failure resulting from thermostats or their associated connections is reduced.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A safety-assuring control device for an electric alternating current appliance which includes a heater having first and second heater feed conductors, said first heater feed conductor being connected to a protective fuse and connectable therethrough to an ungrounded pole of a source of electric alternating current and said second heater feed conductor being connected to an electrically controllable heater switch and connectable therethrough to a grounded pole of said source of electric alternating current, said first and second heater feed conductors, at respective ends remote from said fuse and from said heater switch, being respectively connected to primary and secondary safety link return conductors which lead towards respective connections thereof in said control device, said primary safety link conductor being connected with said secondary safety link conductor, said control device comprising:

an integrated circuit microcontroller unit including:

a first safety circuit input, a second safety circuit input, and an output connected to a control input of said electrically controlled heater switch;

a safety circuit including:

at least one gas discharge current breakdown element connected between said primary safety link return conductor and said first safety circuit input, and producing:

a voltage drop when said at least one gas discharge current breakdown element conducts so as to produce, at said first safety input, a voltage clamped at a steady potential during half waves of one polarity of said alternating current of said alternating current source and at ground potential during half waves of another and opposite polarity of said alternating current, and an open circuit when said at least one gas discharge current breakdown element fails to conduct such that an input signal is supplied to said first safety circuit input which indicates whether there is a first type of fault in said heater, and a first connection between said second safety circuit input and said secondary safety link return conductor such that an input signal is supplied to said secondary safety circuit input which indicates whether there is a second type of fault in said heater; and said microcontroller unit including:

preliminary fault detection means for supplying a limited power test signal in a test mode to said heater for a predetermined period of time prior to a full power operation of said heater, and means for:

controlling operation of said microcontroller unit to terminate supply of current to said heater if at least one fault is detected by said microcontroller at least one of said first and second safety circuit inputs during said predetermined period of time, and controlling operation of said microcontroller unit to supply current to said heater in said full power operation if no fault is detected during said predetermined period of time.

2. A safety-assuring control device according to claim 1, wherein, after said supply of current to said heater is terminated in said test mode, said control device can be reset to continue operation in said test mode.

3. A safety-assuring control device according to claim 1, wherein said microcontroller unit includes a fault counter for counting the number of successive faults that are detected, and means for controlling operation of said device in a safety mode after a predetermined number of successive faults have been detected by said microcontroller unit in said test mode, such that power is terminated to said heater in the safety mode.

4. A safety-assuring control device according to claim 3, wherein said predetermined number of successive faults is three.

5. A safety-assuring control device according to claim 3, wherein said microcontroller unit includes a failure counter for counting the number of times that said microcontroller unit controls operation of said device in said safety mode, and means for disabling said device to prevent immediate restarting thereof when the count in said failure counter reaches a predetermined number.

6. A safety-assuring control device according to claim 5, wherein said predetermined number of said failure counter is five.

7. A safety-assuring control device according to claim 1, wherein said predetermined period of time is 30 seconds.

8. A safety-assuring control device according to claim 1, wherein said limited power test signal has a ⅙ duty cycle with 10 continuous AC on cycles and 50 off cycles per second, lasting for said predetermined period of time of 30 seconds.

9. A safety-assuring control device according to claim 1, wherein said microcontroller unit includes:

full power fault detection means for detecting if there is at least one fault in response to input signals to at least one of said first and second safety circuit inputs during said full power operation, and means for:

controlling operation of said microcontroller unit to terminate supply of current to said heater to stop full power being supplied thereto if at least one fault is detected, and controlling operation of said microcontroller unit to supply current to said heater in said full power operation if no fault is detected.

10. A safety-assuring control device according to claim 9, wherein, after said supply of current to said heater is terminated during said full power operation, said control device can be reset to continue operation in said full power operation.

11. A safety-assuring control device according to claim 9, wherein said microcontroller unit includes fault counter for counting the number of successive faults that are detected, and means for controlling operation of said device in a safety mode after a predetermined number of successive faults have been detected by said microcontroller unit during said full power operation, such that power is terminated to said heater in said safety mode.

12. A safety-assuring control device according to claim 11, wherein said predetermined number of successive faults during said full power operation is three.

13. A safety-assuring control device according to claim 11, wherein said microcontroller unit includes a failure counter for counting the number of times that said microcontroller unit controls operation of said device in said safety mode, and means for disabling said device to prevent immediate restarting thereof when the count in said failure counter reaches a predetermined number.

14. A safety-assuring control device according to claim 13, wherein said predetermined number of said failure counter is five.

15. A safety-assuring control device according to claim 1, further comprising a source of electric direct current supplied at a steady potential; and wherein said microcontroller unit includes an input for an alternating voltage derived from said source of electric alternating current and an input connected with said source of direct current.

16. A safety-assuring control device according to claim 15, further comprising a clamping diode pair connected between said at least one gas discharge current breakdown element and said first safety circuit input for clamping said first safety circuit input of said microcontroller unit to ground or to said potential of said source of direct current.

17. A safety-assuring control device according to claim 15, wherein said connection between said second safety circuit input and said secondary safety link return conductor of said safety circuit includes:

a resistive voltage divider connected between said secondary safety link return conductor and ground potential; and a branch circuit connected between a tap of said resistive voltage divider and said second safety circuit input, said branch circuit including:

a load resistor connected between ground and said second safety circuit input, and a transistor having a switched path with one terminal of said switched path interposed between said second safety circuit input of said microcontroller unit and said load resistor and another terminal of said switched path connected with said source of direct current.

18. A safety-assuring control device according to claim 15, further comprising a low current resistive path connected between said first and secondary safety link return conductors.

19. A safety-assuring control device according to claim 1, wherein the integrated circuit microcontroller includes a third safety circuit input, the control device further comprising:

a second connection between said third safety circuit input and said secondary safety link return conductor such that an input signal is supplied to said third safety circuit input which indicates whether there is a second type of fault in said heater.

20. A safety-assuring control device according to claim 19, further comprising a source of electric direct current supplied at a steady potential; and wherein said microcontroller unit includes an input for an alternating voltage derived from said source of electric alternating current and an input connected with said source of direct current.

21. A safety-assuring control device according to claim 20, wherein said connection between said second safety circuit input and said secondary safety link return conductor of said safety circuit includes:

a resistive voltage divider connected between said secondary safety link return conductor and ground potential; and a branch circuit connected between a tap of said resistive voltage divider and said second safety circuit input, said branch circuit including:

a load resistor connected between ground and said second safety circuit input, and a transistor having a switched path with one terminal of said switched path interposed between said second safety circuit input of said microcontroller unit and said load resistor and another terminal of said switched path connected with said source of direct current.

22. A method for testing the safety of an electric alternating current appliance prior to full power operation thereof, said appliance including a heater having first and second heater feed conductors, said first heater feed conductor being connected to a protective fuse and connectable therethrough to an ungrounded pole of a source of electric alternating current and said second heater feed conductor being connected to an electrically controllable heater switch and connectable therethrough to a grounded pole of said source of electric alternating current, said first and second heater feed conductors, at respective ends remote from said fuse and from said heater switch, being respectively connected to primary and secondary safety link return conductors which lead towards respective connections thereof in said control device, said primary safety link conductor being connected with said secondary safety link conductor, said method comprising the steps of:

supplying a limited power test signal in a test mode to said heater for a predetermined period of time prior to a full power operation of said heater;

terminating supply of current to said heater if at least one fault is detected by said microcontroller at least one of said first and second safety circuit inputs during said predetermined period of time; and supplying current to said heater in said full power operation if no fault is detected during said predetermined period of time.

23. A method according to claim 22, further comprising the step of resetting said control device to continue operation in said test mode after said supply of current to said heater is terminated in said test mode.

24. A method according to claim 22, further comprising the step of counting the number of successive faults that are detected, and controlling operation of said device in a safety mode after a predetermined number of successive faults have been detected in said test mode, such that power is terminated to said heater in the safety mode.

25. A method according to claim 24, wherein said predetermined number of successive faults is three.

26. A method according to claim 24, further comprising the step of counting the number of times that operation of said device enters said safety mode to provide a failure count, and disabling said device to prevent immediate restarting thereof when the failure count reaches a predetermined number.

27. A method according to claim 26, wherein said predetermined number of said failure counter is five.

28. A method according to claim 22, wherein said predetermined period of time is 30 seconds.

29. A method according to claim 22, wherein said limited power test signal has a ⅙ duty cycle with 10 continuous AC on cycles and 20 off cycles per second, lasting for said predetermined period of time of 30 seconds.

30. A method according to claim 22, further comprising the steps of:

detecting if there is at least one fault in response to input signals to at least one of said first and second safety circuit inputs during said full power operation;

controlling operation of said microcontroller unit to terminate supply of current to said heater to stop full power being supplied thereto if at least one fault is detected; and controlling operation of said microcontroller unit to supply current to said heater in said full power operation if no fault is detected.

31. A method according to claim 30, further comprising the step of resetting said device to continue said full power operation after said supply of current to said heater is terminated during said full power operation.

32. A method according to claim 30, further comprising the steps of:

counting the number of successive faults that are detected, and controlling operation of said de vice in a safety mode after a predetermined number of successive faults have been detected during said full power operation, such that power is terminated to said heater in said safety mode.

33. A method according to claim 32, wherein said predetermined number of successive faults during said full power operation is three.

34. A method according to claim 32, further comprising the steps of counting the number of times that said microcontroller unit controls operation of said device in said safety mode to provide a failure count, and disabling said device to prevent immediate restarting thereof when the failure count reaches a predetermined number.

35. A method according to claim 34, wherein said predetermined number of said failure counter is five.

* * * * *